United States Patent [19]

Sweet

[11] Patent Number: 4,832,999

[45] Date of Patent: May 23, 1989

[54] HONEYCOMB STRUCTURE ASSEMBLIES

[75] Inventor: E. Jack Sweet, Trumbull, Conn.

[73] Assignee: Avco Lycoming/Textron, Stratford, Conn.

[21] Appl. No.: 114,100

[22] Filed: Oct. 27, 1987

[51] Int. Cl.[4] ..... B32B 3/12

[52] U.S. Cl. ..... 428/116; 165/10; 428/593

[58] Field of Search ..... 428/116, 593, 118; 60/752, 758; 165/10·R; 52/806

[56] References Cited

U.S. PATENT DOCUMENTS

| | | | |
|---|---|---|---|
| 2,910,153 | 10/1959 | Campbell | 428/116 X |
| 2,983,038 | 5/1961 | Johnson | 428/116 X |
| 3,030,703 | 4/1962 | Wirsing, Jr. | 428/116 X |
| 3,084,770 | 4/1963 | Wirsing, Jr. | 428/593 |
| 3,196,533 | 7/1965 | Ida et al. | 428/116 X |
| 3,869,778 | 3/1975 | Yancey | 428/593 X |
| 3,946,892 | 3/1976 | Rigal et al. | 428/116 X |
| 4,197,341 | 4/1980 | Rule | 428/118 |
| 4,273,836 | 6/1981 | Campbell et al. | 428/116 X |
| 4,365,004 | 12/1982 | Campbell et al. | 428/593 |
| 4,384,020 | 5/1983 | Beggs et al. | 428/593 X |
| 4,642,993 | 2/1987 | Sweet | 428/116 |
| 4,643,933 | 2/1987 | Picken | 428/593 X |

FOREIGN PATENT DOCUMENTS

| | | |
|---|---|---|
| 2112588 | 11/1972 | Fed. Rep. of Germany . |
| 2129032 | 10/1972 | France . |
| 347631 | 10/1960 | Switzerland . |
| 1425123 | 2/1976 | United Kingdom . |

*Primary Examiner*—Henry F. Epstein
*Attorney, Agent, or Firm*—Perman & Green

[57] ABSTRACT

Honeycomb structure assemblies comprising walled structures which admit fluid such as air for purposes of cooling or heating the walls thereof or for other purposes. The assemblies comprise spaced inner and outer walls united by means of an internal honeycomb structure comprising aligned cells having opposed interior and exterior gaps open to adjacent cells, which causes the admitted fluid to undulate through said gaps into contact with both of the walls, such as for uniform cooling or heating. The honeycomb structure contains flanges which are secured to one or both walls for uniform strength and resistance to separation under the stress of use.

13 Claims, 3 Drawing Sheets

HONEYCOMB STRUCTURE ASSEMBLIES

BACKGROUND OF THE INVENTION

The present application relates to improvements in honeycomb structure assemblies such as the cooling structures disclosed in my earlier U.S. Pat. No. 4,642,993 issued Feb. 17, 1987, the disclosure of which is hereby incorporated by reference thereto.

The cooling structures or walled heat exchange structures of U.S. Pat. No. 4,642,993 represent a substantial advance of the art by providing lightweight, inexpensive efficient structures which are relatively simple to manufacture and which permit inspection for quality control purposes during manufacture. The cooling structures of the Patent comprise opposed walls forming therebetween an interior space containing a honeycomb structure, the walls of which extend substantially perpendicularly or radially relative to the opposed walls, depending upon whether the walls are planar or curved.

The honeycomb structure of U.S. Pat. No. 4,642,993 is formed by joining narrow undulated metal strips to each other in an alternating down-and-up or stepped configuration to form a unit having a plurality of honeycomb cells, such as hexagonal cells, the walls of each cell which are formed by the "down" undulated strip extending from the base upward but being short of the top surface of the honeycomb structure, and the walls of each cell which are formed by the "up" undulated strip extending from the top surface of the honeycomb structure but being spaced from the base thereof. Thus, when the honeycomb structure is confined between a base wall and a top wall to form a honeycomb structure assembly, each honeycomb cell is open adjacent the base wall by uniform openings in the cell walls formed by the "up" undulated strip, and is open adjacent the top wall by corresponding uniform openings in the cell walls formed by the "down" undulated strip.

According to U.S. Pat. No. 4,642,993 the base of the honeycomb structure is attached to one wall of the walled cooling structure, such as the interior wall of a combustor liner, by welding or brazing the "down" undulated strips thereto, and the opposed wall, such as the exterior wall of a combustor liner, is wrapped thereover, and fastened to the interior wall by means of spaced spring clips and bolts passing through some of the honeycomb cells. This permits the heat exchange structure to be bent into a curved or annular configuration, prior to insertion of the clips and bolts, to form a unit, or a plurality of arcuate sections which can be assembled as a unit, to form a heating or cooling structure of the desired wall shape. Cooling or heating fluid entering the structure, such as air, is caused to undulate against one wall, such as the interior wall, to enter a honeycomb cell, and then against the other wall, such as the exterior wall, to escape from that honeycomb cell to adjacent cells where the undulation flow pattern is continued to effect cooling or heating of both walls, depending upon the nature and temperature of the fluid.

While the novel walled structure of U.S. Pat. No. 4,642,993 provides substantial areas of improvement over prior known structures it does have limitations relative to overall strength and reliability which preclude or restrict its use in certain important applications. For example, since only the "down" undulated strips are attached to the interior wall, such as by brazing or welding, the assembly does not have any resistance to high internal pressure. Even if the "up" undulated strips are brazed or welded to the exterior wall, the strength of the assembly is dependent upon the attachment of the "up" and "down" undulated stripe to each other and upon the integrity of the weld or braze connecting the edge of each undulated strips to the interior or exterior wall. Moreover, the manufacture of the honeycomb structure of the Patent requires the precise stepped alignment of the undulated stripe while they are brazed to each other in order to insure the uniformity of the coolant passageways or gaps, and assembly requires thin line welding or brazing of the strip edges to the interior or exterior walls, which is possible but requires expensive machinery and skilled operators.

Thus, the present invention is concerned with novel honeycomb structure assemblies which have the advantages of those of U.S. Pat. No. 4,642,993 but which are stronger and more reliable under the effects of the conditions of the use. In addition, the present invention provides novel honeycomb cooling structure assemblies which are easier and less expensive to manufacture, avoiding some of the precision alignment means and skill required for the manufacture of the products of the Patent.

SUMMARY OF THE INVENTION

The present invention relates to novel honeycomb structure assemblies including walled heat exchange structures such as cooling combustor walls and other spaced walled structures designed to receive heat exchange or other fluid, such as air, into the space therebetween for purposes of cooling or heating the spaced walls efficiently and directing the flow of the heat exchange fluid as desired, or for other purposes such as noise reduction.

More specifically, one embodiment of the present invention relates to novel walled heat exchange structure assemblies which are similar in general appearance, function and performance to those of U.S. Pat. No. 4,642,993 but which represent improvements thereover due to changes in the design of the undulated strips forming the honeycomb unit and the means for attaching the honeycomb unit to the spaced walls to produce the assembly.

According to a first embodiment of this invention, the undulated strips used to form the honeycomb unit are generally similar to those disclosed in U.S. Pat. No. 4,642,993 but at least one of the strips further includes a segmented weld flange which extends substantially perpendicularly along one edge of the undulated strip to provide a plurality of weld flange segments, preferably one between each bend or undulation along the length of each strip, to provide a plurality of weld flanges which can be fastened to the adjacent wall of the walled structure. Such flanged undulated strips are fastened to each other in up-and-down, stepped alignment to form honeycomb units generally similar in appearance to those of U.S. Pat. No. 4,642,993 but having a plurality of spaced weld flanges at one or both surfaces thereof adjacent one or both wall surfaces to which the honeycomb unit is to be attached. The weld flanges extend substantially parallel to the supporting wall surface(s) and provide larger stronger attachment sites than is the case where the thin edge of the base of the undulated strips is attached directly to the supporting wall, as in U.S. Pat. No 4,642,993. Also, the offset positions, of the attachment sites, relative to the walls of the undulated strips, renders the attachment more resistant to separation when the supporting walls are bent or flexed than are the continuous line attachment sites of the structures of the patent. Moreover, the honeycomb units of this embodiment may be attached to both the interior and exterior walls.

According to a preferred embodiment of the present invention, the individual undulated strips used to form the honeycomb unit are of sufficient height to extend between the opposed supporting walls, i.e., the interior and exterior walls, and are provided with segmented weld flanges which extend substantially perpendicularly along both the top and bottom edges of the undulated strips to provide a plurality of attachment flange segments, preferably one between each bend or undulation along one edge and one between every other bend or undulation along the other edge, to provide a plurality of flanges which can be welded, brazed or otherwise attached to the adjacent walls of the walled structure, whereby the honeycomb unit is strongly attached to both walls of the assembly for maximum strength and heat transfer. Such strips are provided with fluid gaps by cutting away spaced portions of the strips adjacent said other edge thereof, between every other bend or undulation, i.e., in areas where there are to be no attachment flanges. Such undulated strips are attached to each other in alternating inverted positions to provide a honeycomb unit having attachment flanges at both the upper and lower surfaces and consisting of honeycomb cells having fluid passages adjacent both the upper and lower edges. The flanges of the honeycomb unit are secured to the adjacent surfaces of both of he supporting walls to form a strong honeycomb structure assembly which provides the undulating, dissipating gas flow disclosed in U.S. Pat. No. 4,642,993.

While welded or brazed metallic cooling wall assemblies of the general type disclosed by U.S. Pat. No. 4,642,993 represent a preferred embodiment of the present invention, the novel assemblies of the present invention include walled honeycomb assemblies having their walls and honeycomb units formed from other materials such as plastics, fiberglass-reinforced plastics, metal/boron fiber composites and other structural materials capable of being fastened together by means of heat, solder, adhesive or other conventional fastening means.

DETAILED DESCRIPTION

Figure 1:
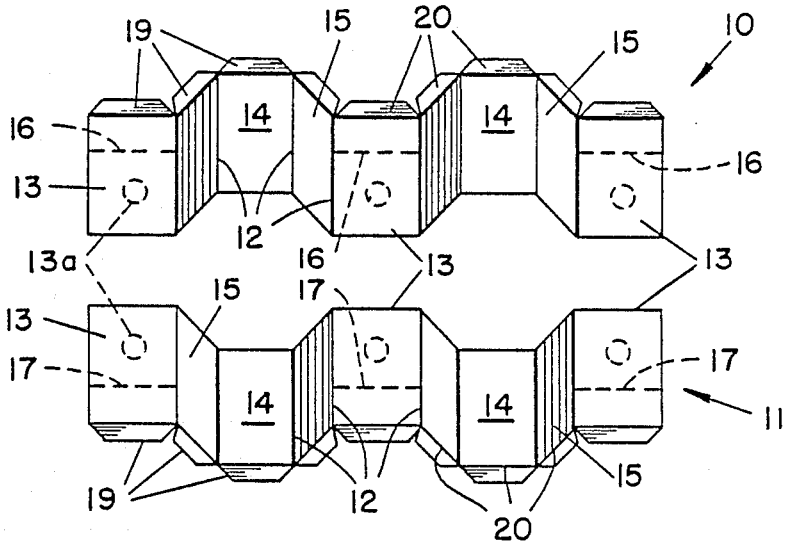
FIG. 1 is a perspective view of undulated strips according to one embodiment of the present invention.

Referring to FIG. 1, a pair of undulated elongate strips 10 and 11 are illustrated in spaced relation, one inverted relative to the other in position to be fastened to each other to form a segment of a honeycomb unit according to one embodiment of the present invention. Strips 10 and 11 are identical elongate metal strips having uniformly spaced transverse folds 12 which divide each strip 10 and 11 into a plurality of uniform-width wall partition segments including strip attachment position segments 13 which are opposed and coplanar with each other, and offset coplanar strip pair attachment partition segments 14 which are also coplanar with each other. The coplanar attachment segments 13 and 14 are connected to each other by means of angular panels 15. In the hexagonal embodiment illustrated, each attachment segment 13 and 14 is connected by means of a singular angular partition segment 15 bent at an angle of 120° relative to the parallel coplanar attachment segments 13 and 14.

Elongate strips 10 and 11 are welded or brazed to each other at intermediate areas by aligning the strip attachment partition segments 13 of each strip in contact with each other, strip 10 being slightly elevated relative to strip 11 so that the top edges of the strip attachment segments 13 of strip 11 are at the positions illustrated by means of broken lines 16 on strip 10 and the bottom edges of the strip attachment segments 13 of strip 10 are at the positions illustrated by means of broken lines 17 on strip 11 in FIG. 1. So positioned, the strips 10 and 11 are welded or brazed at intermediate spots 13*a* to form united pairs of stripes forming honeycomb unit sections which are similarly attached by welding pair attachment to partition segments 14 similar honeycomb unit pair attachments segments 14 to form a plurality of united pairs of honeycomb stripes forming units of the desired dimensions.

Figure 2:
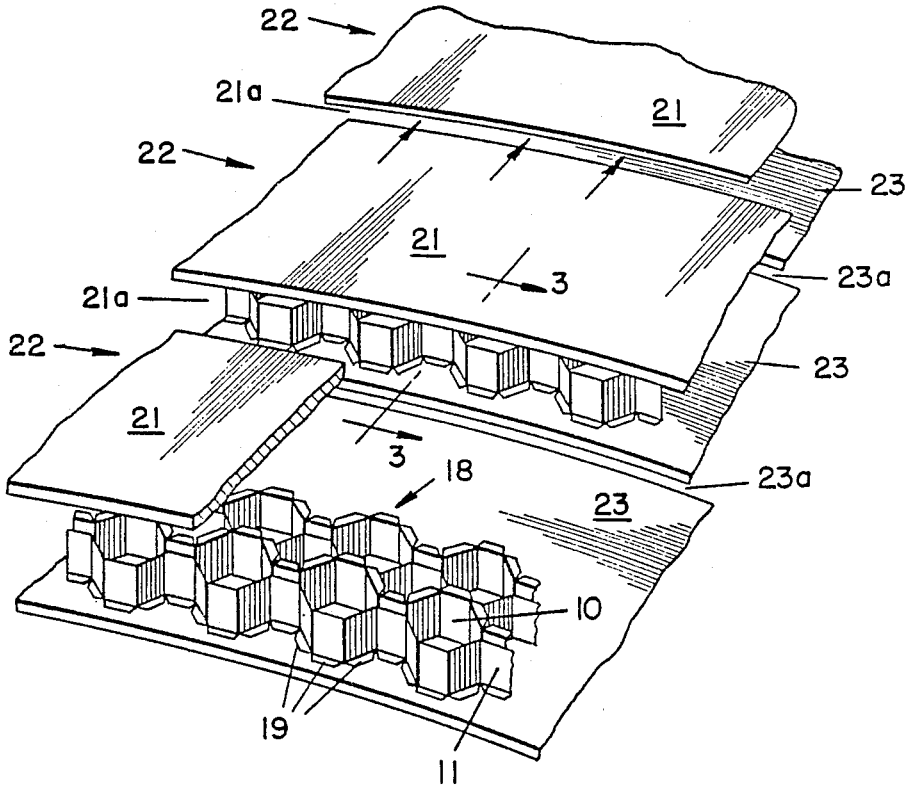
FIG. 2 is a perspective view of a portion of a walled honeycomb structure assembly according to an embodiment of the present invention, incorporating undulated strips of the type illustrated by FIG. 1.

A plurality of such sections are welded or brazed together in similar fashion to form a honeycomb unit of the desired dimensions, i.e., the coplanar pair attachment partition segments 14 of each strip 10 and 11 of each section formed as discussed are welded or brazed to pair attachment partition segments 14 of similar sections of elongate strips 10 and 11 in similar alternating up and down positions to form a honeycomb unit 18 as illustrated in FIG. 2.

The essential novelty of the elongate undulated strips 10 and 11 of FIG. 1, and of the honeycomb unit 18 of FIG. 2 formed therefrom, resides in the segmented attachment flange 19 formed along one edge of the strips 10 and 11 by making V-shaped cuts inwardly along one edge of the strip—forming stock at uniformly—spaced locations corresponding to the intended folds 12 and then folding the segmented flange 19 along a longitudinal fold line 20 until the flange segments extend substantially perpendicular to the panels 13 to 16 from which they extend. After the elongate strip stock is folded to form undulated strips 10 and 11 and such strips are welded or brazed at intermediate points 13*a* of opposed partition to form segments 13 honeycomb units, the attachment flanges 19 of strips 10 provide a plurality of spaced connection points for the upper or exterior wall 21 of the walled structure 22 of FIG. 2 and the attachment flanges 19 of strips 11 provide a plurality of spaced connection points for the lower or interior wall 23 of the walled structure 22 of FIG. 2. Each such connection point is welded or otherwise fastened to form the walled structure 22 which is stronger and more reliable than those disclosed in U.S. Pat. No. 4,642,993.

Figure 3:
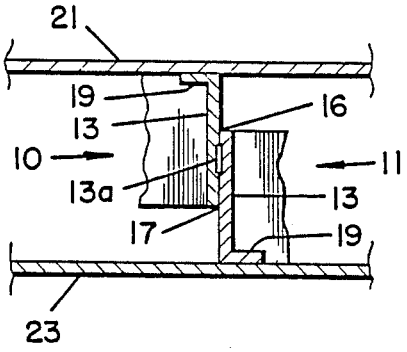
FIG. 3 is a cross-sectional view taken along the line 3—3 of FIG. 2.

As illustrated by the cross-sectional view of FIG. 3, the attachment flanges 19 of strips 10 are welded or brazed to the adjacent surface of the exterior wall 21 and the attachment flanges 19 of strips 11 are welded or brazed to the adjacent surface of the interior wall 23, and the undulated pairs of strips 10 and 11 are welded or brazed to each other at intermediate areas in a vertically-offset or up-and-down alignment, whereby the parallel walls 21 and 23 are securely fastened to the honeycomb unit at a spaced plurality of locations across substantially the entire surface areas of each. The spacing between the top edges of the angular panels 15 of each strip 11 and the inside surface of the exterior wall 21 provides each honeycomb cell with two spaced upper fluid gaps or passages and the spacing between the lower edges of the angular panels 15 of each strip 10 and the inside surface of the interior wall 23 provides each honeycomb cell with two spaced lower fluid gaps or passages, each of said gaps communicating with adjacent honeycomb cells to cause the flow of air or other gas to undulate between contact with each of the walls 21 and 23, and to dissipate throughout the honeycomb structure 18 causing a uniform cooling of the walled structure 22.

Figure 4:
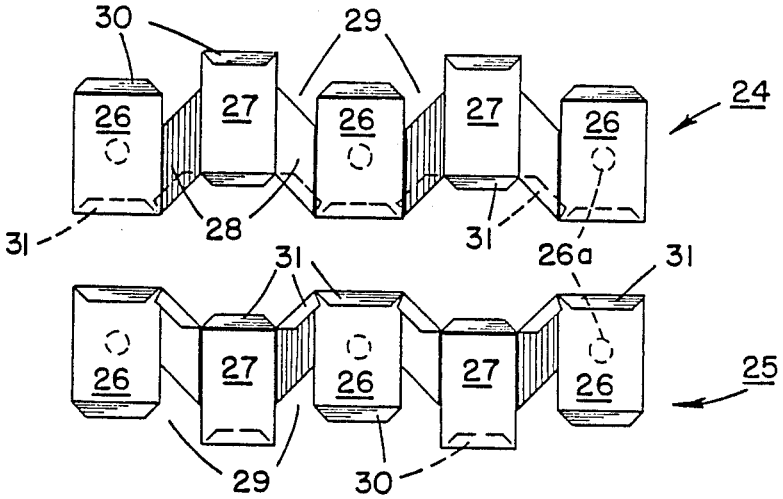
FIG. 4 is a perspective view of undulated strips according to another embodiment of the present invention.

According to a preferred embodiment of the present invention, which avoids the necessity of aligning the elongate undulated strips in vertically-offset or up-and-down position and assures the formation of honeycomb structure assemblies having exceptional strength and uniform flow gaps, the elongate undulated strips 24 and 25 have the design illustrated by FIG. 4 of the drawings. Strips 24 and 25 are identical to each other but one is inverted or turned upside down relative to the other so as to provide upper and lower flow gaps, as will be discussed. Each strip 24 and 25 consists of alternate coplanar attachment partition segments 26 and 27, which extend parallel to each other, and angular connecting partition segments 28 which terminate inwardly from one edge of the strips 24 and 25 to provide uniform flow gaps 29. Each strip 24 and 25 is provided with a segmented attachment flange 30 along one edge, to which the gaps 29 are adjacent, and a segmented attachment flange 31 along the opposite edge, as illustrated.

As in the embodiment of FIG. 1, the attachment flanges 30 and 31 are formed by making uniformly spaced V-cuts inwardly along the edges of the flat strip stock in areas corresponding to the transverse folds to be made between the partition segments. Then portions of the partition segments 28 are cut away, inwardly along one edge, to form the gaps 29. The segmented flange 30 is folded or bent in alternating directions into substantially perpendicular position so that the flange portions on partition segments 26 and 27 extend towards each other. Similarly, the segmented flange 31 along the other edge is bent or folded into perpendicular position so that the flange portions 31 on attachment partition segments 26 and 27 extend in the same direction as the flange portions 31 on said attachment partition segments. The direction of extension of the flange portions 31 on angular partition segments 28 is not important.

Elongate undulated strips 24 and 25 are aligned and contacted, with strip attachment partition segments 26 of each strip in uniform surface contact, and strip attachment partition segments 26 of each strip are welded or brazed together at intermediate spots **26*a* to form a section of the honeycomb unit. Similar sections are formed and united, such as by welding or brazing the planar pair attachment partition segments 27 of two such sections to the planar panels 27 of the section of FIG. 4. The directions of extension of the weld flanges 30 and 31 on planar partition segments 26 and 27 permits the faces of such partition segments to be placed in intimate surface contact for the welding operation. The formed honeycomb unit 32 is illustrated by FIG. 5**.

Figure 5:
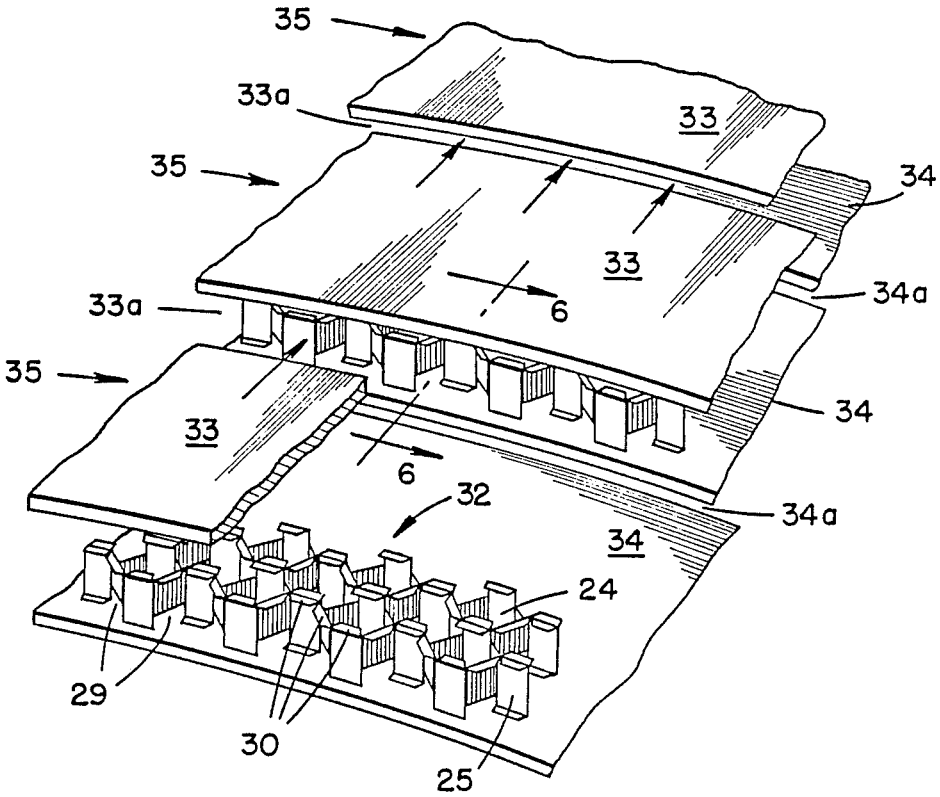
FIG. 5 is a perspective view of a portion of a walled honeycomb structure assembly according to another embodiment of the present invention, incorporating undulated strips of the type illustrated by FIG. 4.

Referring to FIG. 5, the honeycomb unit 32 has upper and lower segmented flanges 30 and 31 which are welded or brazed to the adjacent surfaces of the exterior and interior walls 33 and 34 to form a walled structure 35 of exceptional strength and uniformity of dimensions of the cooling fluid gaps 29. Such a structure is easier to manufacture than those of U.S. Pat. No. 4,642,993, avoiding the need for precision alignment equipment, and is exceptionally strong since each of the undulated strips 24 and 25 is fastened to both the interior and exterior walls.

Figure 6:
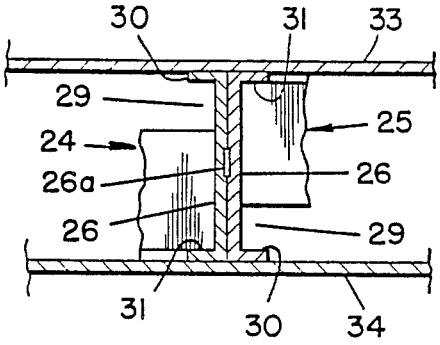
FIG. 6 is a cross-sectional view taken along the line 6—6 of FIG. 5.

FIG. 6 illustrates the cross-sectional interconnection between the parallel walls 33 and 34 and the honeycomb unit 32. The adjacent attachment flanges 30 and 31 of inverted panels 26 (and 27), of strips 24 and 25 extend away from each other so as not to interfere with the surface contact between panels 26, welded at point **13*a*, and each strip 24 and 25 carries both the upper and lower flanges 30 and 31 which are welded to the walls 33 and 34** for exceptional strength and resistance to separation.

The present walled structures can be manufactured in a number of different manners, sizes and configurations from a number of different structural materials depending upon the end use to which they are to be put. As disclosed in U.S. Pat. No. 4,642,993 the walled structure can be made by attaching individual undulated strips, such as 11 of FIG. 1 and 25 of FIG. 2, to one supporting wall such as 23 of FIG. 2 and 34 of FIG. 5 and then attaching the individual undulated strips 10 of FIG. 1 and 24 of FIG. 2 to the strips 11 and 25 which are attached to the supporting wall, in order to build up the attached honeycomb structure. Preferably, the honeycomb structure is first formed as a unit and is then attached to the inner and/or outer walls.

The present walled structures can be assembled in stepped relation, as shown by FIGS. 3 and 4 to provide inlet and outlet slots and/or spaced inlet and outlet ports may be provided in the inner and outer walls to admit a fluid, such as air, hydrogen, water or other fluid for circulation through the honeycomb labyrinth to cool or heat both walls and to extract the fluid at one or more remote locations.

The present walled structures may be unitary or may be assembled as a plurality of structural units, such as annular units which are attached to or form an annular element having cooling or heating requirements, such as a combustor chamber, reactor, or the like. In an annular configuration the honeycomb cells generally extend radially with respect to the longitudinal axis of the combustor or reactor. In the illustrated embodiments of FIGS. 2 and 5, the assembled sections 22 and 35 are radially-offset relative to each other to provide exterior inlet slots **21*a* and 33*a* which open to a plurality of exterior honeycomb gaps for the admission of fluid to the honeycomb structures of the upstream end of the structure sections, and interior slots 23*a* and 34*a*** which open to a plurality interior honeycomb gaps for the discharge of fluid from the honeycomb structure at the downstream end.

While the present walled honeycomb structure assemblies are well suited for use as combustor liners for gas turbine engines in the manner disclosed by U.S. Pat No. 4,642,993, they are also suitable for a variety of different uses having heat exchange requirements, such as space vehicle wings and bodies, nuclear reactor housings, solar heat panels, heat shields and a variety of other elements which have cooling or heating requirements. Moreover, the present walled honeycomb structure assemblies can be fabricated from plastics, laminates, composites and other materials for purposes other than heat exchange purposes, such as muffling or noise reduction purposes, aeration purposes, flow dissipation purposes, gas and/or liquid mixing purposes and other uses which will be apparent to those skilled in the art in the light of the present disclosure. The nature of the materials from which the present assemblies are fabricated will dictate the nature of the means used to fasten the undulated strips to each other to form the honeycomb structure and to fasten the honeycomb structure to the interior and exterior walls.

Although variations are shown in the present application, many modifications and ramifications will occur to those skilled in the art upon a reading of the present disclosure.

What is claimed is:

1. A honeycomb structure assembly comprising an interior wall, an exterior wall spaced from the interior wall to form a space disposed between said walls, a plurality of pairs of undulated strips which are united to each other and to adjacent pairs of strips to form partitions of a honeycomb structure comprising a multiplicity of adjacent cells extending from said interior wall to said exterior wall within said space, each said cell having two opposed partition segments which are welded at intermediate areas to partition segments of adjacent cells to form welded partition segments pairs which extend from the interior wall to the exterior wall and which unite said strips and strip pairs, at least one welded partition segment of each welded segment pair having narrow flanges extending substantially perpendicularly from the base portion thereof, adjacent said interior wall, said flanges being attached to said interior wall, and the other welded partition segment of each welded segment pair having narrow flanges extending substantially perpendicularly from at least the top portion thereof, adjacent said exterior wall, portions of at least one of the partition segments forming each said cell providing an opening adjacent said exterior wall to define at least one exterior gap in said cell, and portions of at least one other partition segment forming each said cell providing an opening adjacent said interior wall to define at least one interior gap in said cell, whereby fluid directed through the interior and exterior gaps of said cells flows in an undulating pattern to contact both the interior and exterior walls of said assembly.

2. An assembly as in claim 1 wherein sad narrow flanges are metallic and are welded or brazed to said interior wall which is also metallic.

3. An assembly as in claim 1 in which the narrow flanges extending substantially perpendicularly from the top portions of said partitions are attached to said exterior wall.

4. An assembly as in claim 1 in which all of said undulated strips are provided with narrow flanges extending substantially perpendicularly from both the top and bottom portions thereof, the bottom flanges being attached to the interior wall and the top flanges being attached to the exterior wall.

5. An assembly as in claim 1 in which the individual undulated strips have a height less than the space between said walls and alternate strips are attached to each other in vertical misalignment so that the base portion or some such strips has said narrow flanges attached to said interior wall and the top portion of alternate strips contacts said exterior wall.

6. An assembly as in claim 5 in which the top portion of said alternate strips also has narrow flanges extending substantially perpendicularly therefrom which are attached to said exterior wall.

7. An assembly as in claim 1 wherein the cells defined by said honeycomb structure are generally hexagonal in cross-section.

8. A heat exchange structure formed from a plurality of sections comprising honeycomb structure assemblies as defined in claim 1, each said assembly being generally annular and including:

a generally annular interior wall;

a generally annular exterior wall spaced radially from said interior wall; and a said honeycomb structure disposed between and in contact with said interior and exterior walls, said honeycomb structure defined by a plurality of honeycomb cells extending radially with respect to a longitudinal axis of the heat exchange structure, whereby said heat exchange structure enables the flow of fluid through the exterior and interior gaps of said cells to contact both the interior and exterior walls of said assembly for heat exchange purposes.

9. A structure as in claim 8 wherein each said section thereof is radially offset from the section adjacent thereto.

10. A structure as in claim 8 wherein each said section includes an upstream end and an axially opposed downstream end, each said honeycomb structure being formed to define a plurality of said exterior gaps adjacent said upstream end and a plurality of interior gaps adjacent said downstream end.

11. A structure as in claim 8 wherein the exterior walls of adjacent sections are integral with one another.

12. A heat exchange structure formed from a plurality of sections comprising honeycomb structure assemblies as defined in claim 3.

13. A heat exchange structure formed from a plurality of sections comprising honeycomb structure assemblies as defined in claim 4.

* * * * *